United States Patent [19]

Wild

[11] 4,378,939

[45] Apr. 5, 1983

[54] BED FRAME SIT-UP EXERCISER

[76] Inventor: Norman W. Wild, 3762 Locust Ave., Long Beach, Calif. 90807

[21] Appl. No.: 153,441

[22] Filed: Oct. 22, 1980

[51] Int. Cl.[3] ..... A63B 23/02

[52] U.S. Cl. ..... 272/93; 272/900; 5/508

[58] Field of Search ..... 272/93, 109, 136, 144, 272/145, 900; 5/77, 78, 84, 503, 504, 507, 508

[56] References Cited

U.S. PATENT DOCUMENTS

| | | | |
|---|---|---|---|
| 1,969,165 | 8/1934 | Turner | 272/136 |
| 2,941,215 | 6/1960 | Johnson | 5/507 |
| 3,218,070 | 11/1965 | Crowther | 272/136 X |
| 3,497,882 | 3/1970 | Weeks | 272/93 |
| 3,896,787 | 7/1975 | Withers | 272/93 X |
| 4,185,816 | 1/1980 | Bernstein | 272/900 X |
| 4,212,458 | 7/1980 | Bizilia | 272/900 X |

*Primary Examiner*—Richard J. Johnson

[57] ABSTRACT

A device for holding a person's feet while doing "sit-up" exercises or the like, comprising a plate anchored to the left or right side of the metal "L" frame on either side of bed.

Exerciser can be used in any radius from 0° to 180° on either side of bed. Apparatus has a pivot arm, attached to plate anchored to under side of "L" frame by two (2) unique pressure clamps that are employed to hold mounting plate on "L" frame with wing nuts, eliminating the need for holes to be drilled in bed frame. Exerciser has an oval ring which is attached to pivot arm on the outward end. Oval ring has foam cushion installed so the person's feet will be comfortable while doing sit-ups or the like.

6 Claims, 6 Drawing Figures

Fig. 1
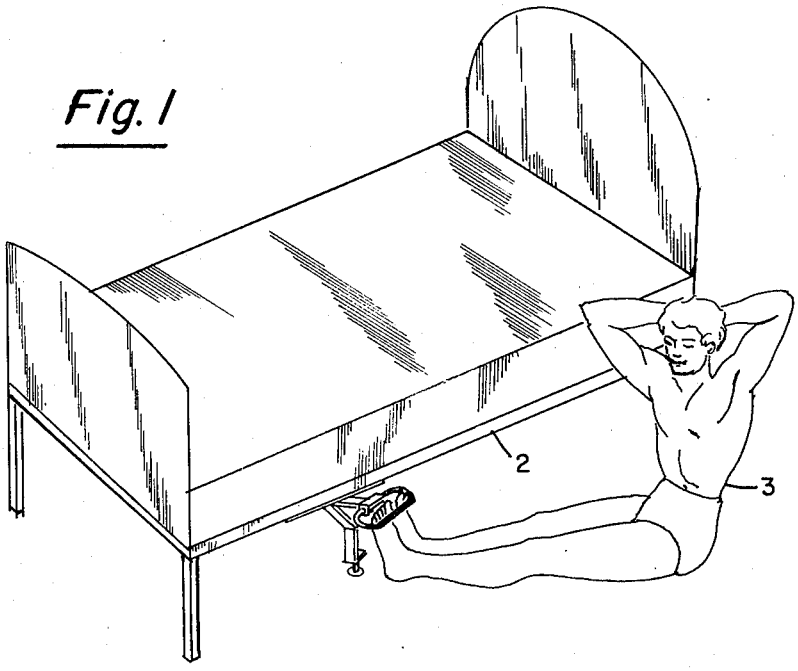
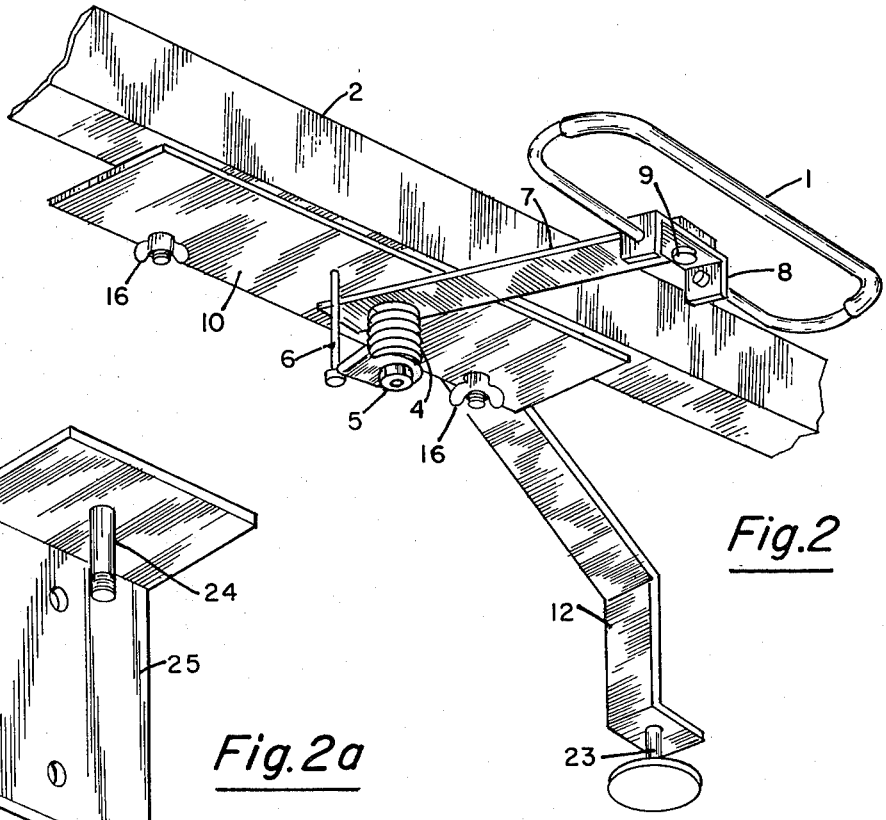
Fig.2
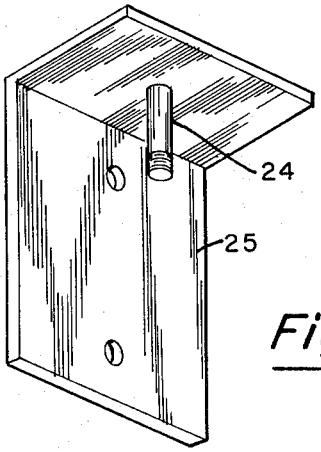
Fig.2a

BED FRAME SIT-UP EXERCISER

BACKGROUND OF THE INVENTION

One of the best indoor exercises for abdominal area of the body is sit-ups. It is also noted that more people are becoming interested in exercising regularly. Sit-ups can be done with one person holding another person's feet or sticking the feet under the bed, a chair, etc. This is hard on the metatarsal part of the foot.

There are several U.S. Pat. Nos. such as 4,212,458 and 4,185,816 using a door as a base support. In both cases these units stand out in the road for possible injuries in the dark or stumbling anytime.

For this reason I feel that the bed frame sit-up exerciser is more efficient because it is out of the way when not in use, stowed under the bed. It can be extended when being used and will self retract under the bed when the feet are removed.

OBJECTS OF THE INVENTION

The object of present invention is to make it easy for a person to do sit-ups with an exercising apparatus that will be able to be used anytime a person wants to without spending time to set apparatus up because it will be permanently installed on a bed frame under the bed. Another object of this exerciser is the ease in which it can be installed on a bed and be out of the way until someone wants to do sit-ups or the like.

Another object of this exerciser is that a person only has to pull the cushion loop of the exerciser out from under the bed and put their feet in the loop and do sit-ups and when the feet are removed the loop will retract back under the bed and out of the way and out of view until the next time a person want to do sit-ups or the like.

This exerciser installs on a bed frame very easily, with two special pressure clamps, in about one minute of time and can stay on the bed frame indefinitely or it can be removed in about one minute of time.

BRIEF DESCRIPTION OF DRAWING

A preferred embodiment of sit-up exercisr is illustrated by drawing accompanying invention of which:

FIG. 1 is a drawing of bed with exerciser attached to "L" frame. Oval insulated ring is in extended position.

FIG. 2 shows how exerciser is attached to "L" frame of bed. Note: Exerciser can be installed anywhere along bed frame with pressure clamps.

DETAIL DESCRIPTION

Figure 3:
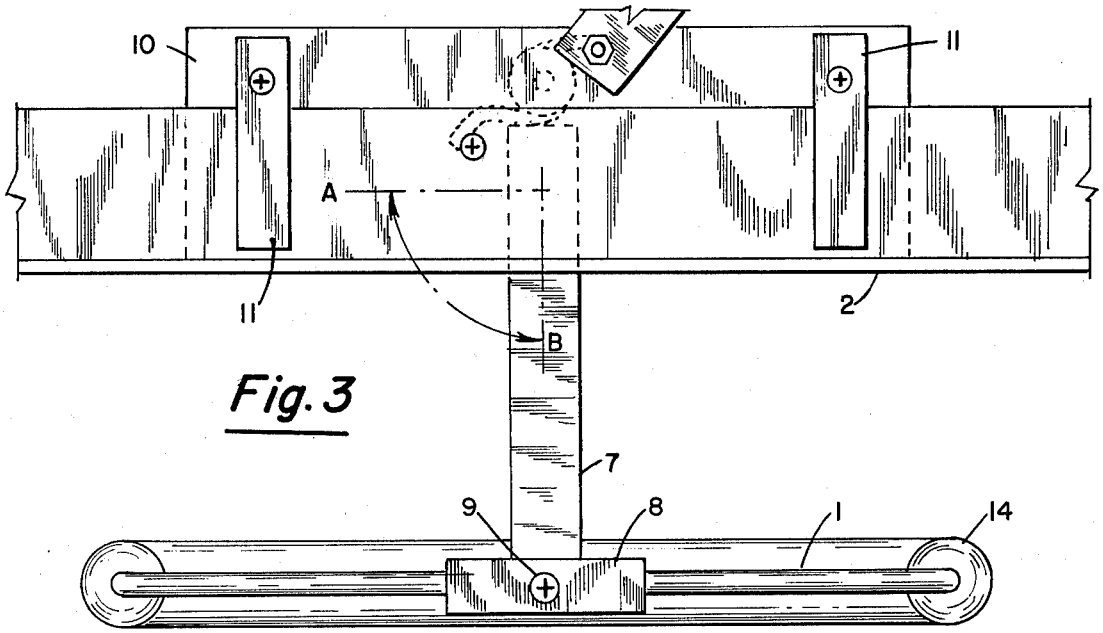
FIG. 3 is a top view of exerciser with pressure clamps holding exerciser plate to "L" frame. Pivot arm is in extended position.

The bed frame sit-up exerciser illustrated in FIG. 1 shows bed frame exerciser attached to bed frame 2. FIG. 1 also shows a man in a sit-up position. Exerciser is shown in the extended or work position with person's feet in padded oval ring (loop) ready to do sit-ups or the like.

Drawing in FIG. 2 shows said exerciser plate 10 attached to bed frame 2 with pressure clamps and wing nuts 16. Exerciser arm 7 is pivoted on stud 5, welded to plate 10, and held in position with said nut on stud 5 and stud 6. Mounting arm outer pivotal welded stud 9 holds "U" shape clamp 8 on mounting arm 7. This gives "U" shape clamp 8 a 360° turning capability vertically and 260° horizontally making it possible to use said exerciser in a restricted area. As seen in FIG. 2A, the mounting clamp 25 is used for mounting on box bed frame or water bed frame by using two (2) wood screws. Stud 24 will secure exerciser arm 7 to said stud, thus using hardware explained in FIG. 2 but eliminating mounting plate 10.

Figure 4:
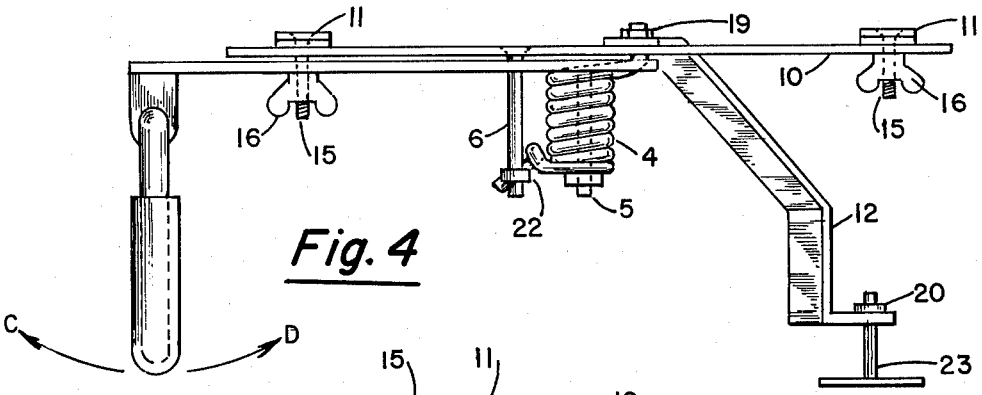
FIG. 4 is front view of exerciser in the relaxed or stowed position which would be under bed. This also shows support bracket on exerciser plate.

As seen in FIG. 3, the exerciser plate 10 is anchored to bed frame 2 by pressure clamps 11. The pivot arm 7 is in the extended (exercising) position. "U" clamp will pivot 360° on stud 9. FIG. 4 is front view of exerciser as it will look stowed under bed in the hidden (stowed) position.

As seen in FIG. 4, the exerciser plate 10 has two (2) pressure clamps 11 to hold mounting plate to bed frame 2. Spring means 4 keep tension on exerciser arm so arm and loop will return to stowed position under bed when not in use. Welded stud 5 holds spring 4 and arm 7 in position with nut and washer. Oval loop 1 is attached to U shape bracket 8 that will turn 360°. C and D shows axis that oval loop will move. Stud bolt 15 on pressure clamp 11 is assisted by wing nut 16 to hold exerciser plate 10 to bed frame 2. An extra support bracket 12 is anchored to exerciser plate 10 by nut and stud 19 and extension comes close to the floor whereby an extension such as adjustable leveling leg 23 can be raised or lowered to reach the floor thus giving the counter acting support to the bed frame when a heavier person uses bed frame exerciser for sit-up or the like.

Figure 5:
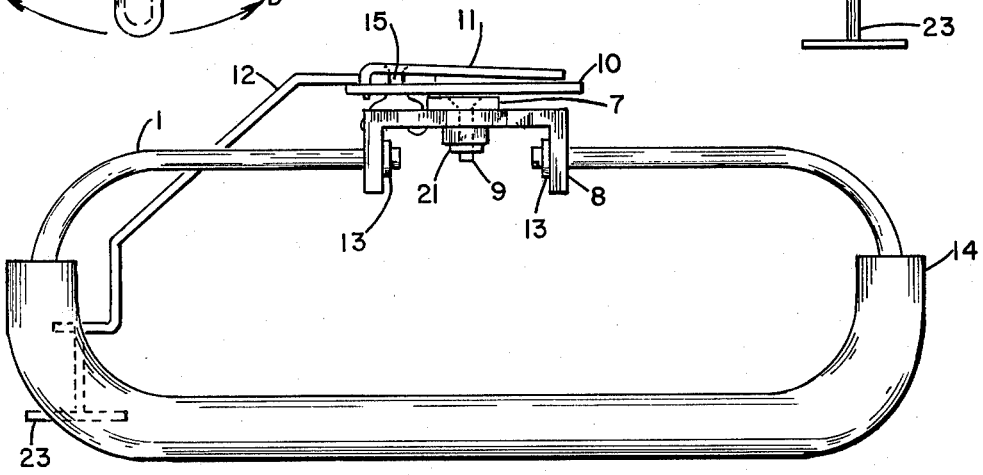
FIG. 5 is side view showing exerciser and pressure clamps used to hold exerciser on bed frame. Foam rubber insulation is shown on oval ring or loop.
Figure 5:
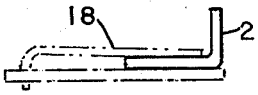

FIG. 5 is side view of exerciser, as apparatus is set in retracted or stowed position without being attached to bed frame. Pressure clamp 11, attached to exerciser plate 10, can be seen in drawing with pressure clamp attached to bed frame 2 off to right side of 10 and 11, pressure clamp assembly.

U shape clamp is seen holding oval loop 1 in place with two (2) retaining ring clamps 13. Oval loop 1 has resilient cushioning material 14 on it making it easier on the feet when doing sit-up or the like. U shape bracket 8 is held to exerciser arm 7 by stud bolt 9 and nut 21.

I claim:

1. A sit-up exercise device to be utilized in conjunction with a bed having a frame, said device comprising:

(a) a mounting plate;

(b) means for detachably securing said mounting plate to the bed frame;

(c) a mounting arm pivotally connected to said mounting plate at one end thereof so as to be movable from a position substantially parallel to said mounting plate to an angular position relative thereto;

(d) a foot engaging loop located at the other end of said mounting arm;

(e) means for pivotally connecting said loop to said other end of said mounting arm, said pivotal connecting means including means for permitting said loop to pivot about a vertical and horizontal axis relative to said mounting arm; and (f) spring means for connecting said one end of said mounting arm to said mounting plate to permit said mounting arm to be placed into one of a plurality of angularly oriented use positions and to retract said mounting arm to a position substantially parallel to said mounting plate in a nonuse position.

2. A device as defined in claim 1 wherein said loop comprises a rod covered with a resilient cushioning material.

3. A device as defined in claim 1 wherein said spring means comprises a coil spring.

4. A device as defined in claim 1 wherein said detachable means comprises a pair of pressure clamps and wing nuts.

5. A device as defined in claim 1 wherein said pivotal connecting means includes a substantially U-shaped clamp having a first pivotal mounting means for said rod and a second pivotal mounting means for said mounting arm.

6. A device as defined in claim 1 further including a support bracket, said support bracket having one end mounted on said mounting plate and having an adjustable ground engaging leg at its other end.

* * * * *